US011688952B1

(12) United States Patent
Salem et al.

(10) Patent No.: US 11,688,952 B1
(45) Date of Patent: Jun. 27, 2023

(54) CURRENT SHEET ARRAY ANTENNA

(71) Applicant: Ball Aerospace & Technologies Corp., Boulder, CO (US)

(72) Inventors: Matthew G. Salem, Westminster, CO (US); Sean P. Finn, Westminster, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 17/537,758

(22) Filed: Nov. 30, 2021

Related U.S. Application Data

(60) Provisional application No. 63/120,585, filed on Dec. 2, 2020.

(51) Int. Cl.

| | |
|---|---|
| ***H01Q 21/06*** | (2006.01) |
| ***H01Q 9/16*** | (2006.01) |
| ***H01Q 1/48*** | (2006.01) |
| ***H01Q 1/38*** | (2006.01) |

(52) U.S. Cl.
CPC ..... *H01Q 21/06* (2013.01); *H01Q 1/38* (2013.01); *H01Q 1/48* (2013.01); *H01Q 9/16* (2013.01)

(58) Field of Classification Search
CPC ..... H01Q 21/06; H01Q 1/38; H01Q 1/48; H01Q 9/16
USPC ..... 343/810
See application file for complete search history.

(56) References Cited

U.S. PATENT DOCUMENTS

| | | | | |
|---|---|---|---|---|
| 2004/0104860 | A1 | 6/2004 | Durham et al. | |
| 2017/0338558 | A1 | 11/2017 | West | |
| 2018/0205134 | A1* | 7/2018 | Khan | H01Q 5/314 |
| 2018/0316098 | A1 | 11/2018 | Amadjikpe | |
| 2021/0013627 | A1* | 1/2021 | Goto | H01Q 13/206 |

FOREIGN PATENT DOCUMENTS

WO WO 2018/077408 5/2018

OTHER PUBLICATIONS

Official Action for U.S. Appl. No. 16/876,941, dated Feb. 14, 2022 19 pages.
Official Action for U.S. Appl. No. 16/876,941, dated Jun. 1, 2022 20 pages.
Notice of Allowance for U.S. Appl. No. 16/876,941, dated Aug. 24, 2022 7 pages.

* cited by examiner

*Primary Examiner* — Andrea Lindgren Baltzell
(74) *Attorney, Agent, or Firm* — Sheridan Ross P.C.

(57) ABSTRACT

Systems and methods for providing a broadband antenna are provided. The antenna can include a current sheet array having a plurality of elements. Each of the elements includes dipole arms. The dipole arms can be configured as first and second dipole arm pairs for transmitting or receiving signals of different polarizations. Capacitive structures are provided between adjacent branch portions of the dipole arms. The capacitive structures extend from a first side of a substrate on which the dipole arms are located towards a second side of the substrate.

20 Claims, 8 Drawing Sheets

CURRENT SHEET ARRAY ANTENNA

CROSS-REFERENCE TO RELATED APPLICATIONS

This application claims the benefit of U.S. Provisional Patent Application Ser. No. 63/120,585, filed Dec. 2, 2020, the entire disclosure of which is hereby incorporated herein by reference.

FIELD

The present disclosure is generally related to antennas and more particularly to current sheet arrays.

BACKGROUND

The development of two-dimensional planar broadband antennas has long been investigated. Current sheet arrays may be chosen over Vivaldi and loaded slot designs because they have a reduced depth, dual polarization (i.e., horizontal and vertical polarization) and small two-dimensional element spacing. Conventional current sheet arrays comprise three modes: a radiating resonant mode, a non-radiating common mode, and a radiating dipole mode. The radiating resonant mode is generally driven by the height of the array, the lattice spacing, and the capacitance between elements. The dipole mode is driven by the lattice spacing. Generally, the lattice size is chosen to fix the dipole mode, and the height and capacitance are chosen to fix the resonant mode. Under normal circumstances, the non-radiating common mode existing in conventional current sheet arrays occurs at a frequency between the radiating resonant and dipole modes. This common mode thus reduces the effective bandwidth of the antenna. Many attempts have been made to reduce or eliminate the common mode in order to connect the two radiating modes and produce an extremely wideband antenna.

For example, some conventional current sheet arrays have been developed with vias disposed so as to move the resonant and common modes above the dipole mode to provide wideband performance. By doing this, the antenna is no longer electrically small compared to its radiation band (i.e., the dipole forms the low end of the radiation band). Constructing current sheet arrays with vias configured in this way can come at the expense of high band grating lobes when placed on larger lattices.

In order to increase the bandwidth of a current sheet array, one approach is to increase the capacitance between elements. This has been done by overlapping elements or by interleaving or interdigitating portions of the planar elements in a horizontal plane. However, the increases in capacitance and in antenna performance using such approaches has been limited.

Other conventional current sheet arrays have been developed using BALUN-fed current sheet arrays in which the common mode is removed, allowing for wideband performance. However, this wideband performance comes at the expense of increased circuitry, a more difficult build procedure and a larger depth of the current sheet array. The inclusion of a BALUN with a current sheet array makes the integration with a complex feed network very difficult to manufacture.

What is needed is a current sheet array in which the common mode is eliminated without the negative aspects existing in conventional current sheet arrays. In addition, a current sheet array that is also dual polarized, small in size, easy to manufacture, capable of being curved to fit conformal applications, with no non-radiating common mode is desired.

SUMMARY

Embodiments of the present disclosure provide array antennas, and in particular a current sheet array antennas, with broadband characteristics, and methods to broadband current sheet array antennas, by providing antenna elements having increased inter-element capacitance as compared to alternative designs. Configurations in accordance with embodiments of the present disclosure can enable the provision of antennas having a relatively broad operational bandwidth.

In accordance with embodiments of the present disclosure, an antenna array or current sheet array antenna is provided in which inter-element capacitance is increased through the inclusion of capacitive structures or features that extend in a direction that is at an angle to a plane of the dipole elements themselves. In accordance with at least some embodiments of the present disclosure, the capacitive structures are in the form of vertically facing walls or vias between the dipole arms or dipoles of each element. More particularly, each element may include orthogonally coupled dipole arms, which enables horizontally polarized (H-pol) and vertically polarized (V-pol) transmit or receive capability. The capacitive features, such as vertically facing walls or vias, between adjacent H-pol and V-Pol dipole arms, increase the capacitance between the arms. This in turn enables the bandwidth of the element to be extended as compared to a configuration in which a lower capacitance is provided. Moreover, this configuration provides a higher maximum capacitance for a given element area as compared to alternative designs. In addition, embodiments of the present invention can provide an antenna that is electrically small as compared to alternative designs.

An element incorporating dipole arms and capacitive structures as disclosed herein can be manufactured singly or as part of an array of elements using common printed circuit board (PCB) techniques. For example, a ground plane and dipole elements can be formed from conductive layers of a multi-layer board or structure. The capacitive structures or features are generally disposed perpendicular to the ground plane. The capacitive structures can be formed as plated vias. In accordance with further embodiments of the present disclosure, the capacitive structures can be formed by plating the edges of walls formed on a substrate or insulating layer. Accordingly, embodiments of the present disclosure can be manufactured simply and inexpensively using traditional PCB build processes.

Additional features and advantages of embodiments of the disclosed antennas, antenna systems, and me34thods will become more readily apparent from the following description, particularly when taken together with the accompanying drawings.

DETAILED DESCRIPTION

Figure 1:
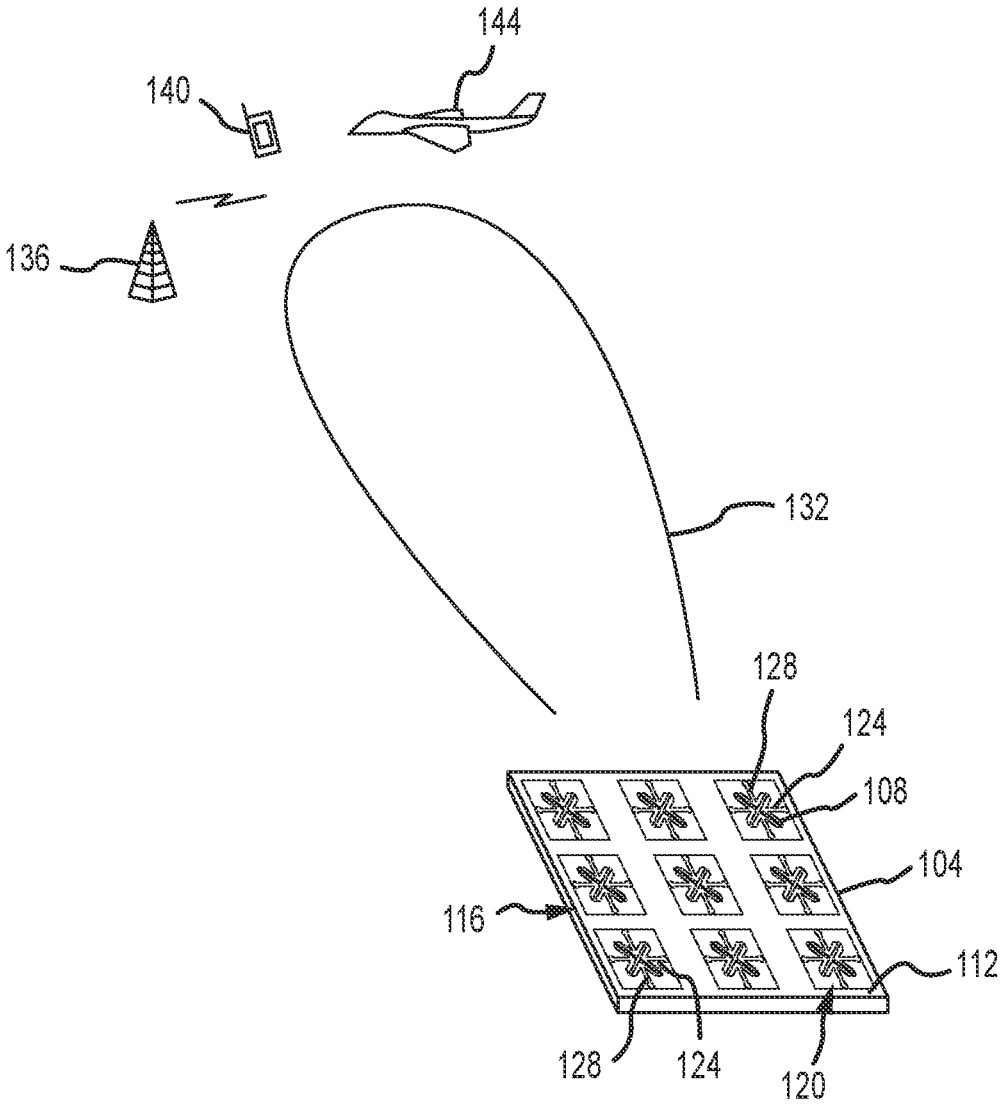
FIG. 1 depicts an antenna system including an antenna with an array of antenna elements in accordance with embodiments of the present disclosure in an example operational scenario.

As depicted in FIG. 1, an array antenna 104 in the form of a current sheet array in accordance with embodiments of the present disclosure can include multiple individual radiating elements or antenna elements 108, disposed on or adjacent a surface of an antenna substrate 112 in the form of an array or matrix 116. Moreover, each element 108 can include pairs of electrically conductive dipole arms 120. In particular, each element can include a horizontally polarized (H-pol) dipole arm pair 124 and a vertically polarized (V-pol) dipole arm pair 128. Moreover, as discussed further elsewhere herein, embodiments of the present disclosure include capacitive structures that increase an area between facing dipole arms 124 and 128 within individual elements 108, thereby increasing the capacitance between those arms 124 and 128. The array antenna 104 can be mounted to a platform, such as but not limited to a tower, aircraft, missile, ship, truck, or any other stationary structure or mobile device.

The elements 108 of an array antenna 104 in accordance with embodiments of the present disclosure can be operated to receive, transmit, or transmit and receive electromagnetic signals or beams 132. The electromagnetic signals 132 can include communication signals sent between the antenna 104 and communication system base stations 136, mobile devices 140, or other communication devices, signals sent as part of radar systems to determine the presence and location of distant objects 144, signals received from other transmission sources that the antenna is operational to detect as part of a signal or threat warning system, or any other purpose. In accordance with at least some embodiments of the present disclosure, signals associated with individual elements 108 can be phased relative to other elements to steer the beam 132. In accordance with still other embodiments of the present disclosure, signals associated with different dipole arm pairs 124 and 128 are orthogonally polarized from one another.

In some embodiments, a current sheet array antenna 104 may be a computer-controlled array of antenna elements 108 configured to create a beam of radio waves which may be electronically steered to point in a wide range of directions without requiring the array antenna 104 to be physically moved. Accordingly, an array antenna 104 as described herein may be configured as an active phased array. Alternatively or in certain operating modes, an array antenna 104 in accordance with embodiments of the present disclosure can be configured or operated as a passive phased array. Beamforming or spatial filtering may be used for directional signal transmission or reception by the array antenna 104. In some embodiments, adaptive beamforming may be used to detect and estimate a signal of interest. It should be appreciated that in some embodiments the array antenna 104 may be designed to be physically moveable or stationary. The signals 132 transmitted or received by the array antenna 104 may be of various wavelengths or bands of wavelengths.

An array antenna 104 as described herein may be in communication with a computer or other control system. The computer system may execute software configured to control signals transmitted by the array antenna 104 via a feed network. The computer system may further be capable of processing signals received by the array antenna 104. In some embodiments, the array antenna 104 may be used to transmit and/or receive signals in a variety of directions at a single time. As described herein, the array antenna 104 may utilize a wide bandwidth and be capable of transmitting signals 132 at frequencies or ranges of frequencies not capable of being transmitted by conventional current sheet arrays. For example, each of the signals 132 may be one of a low-, mid-, and high-frequency signal. The array antenna 104 may further be capable of detecting and receiving signals 132 over a wide range of frequencies. For example, in addition to or as opposed to transmitting signals, an array antenna 104 as described herein may further be configured to detect and/or receive signals. An array antenna 104 in accordance with at least some embodiments of the present disclosure can lower the frequency of the resonant mode of the antenna elements 108 as compared to alternative configurations by providing for increased capacitance between the dipole arms 120.

Figure 2:
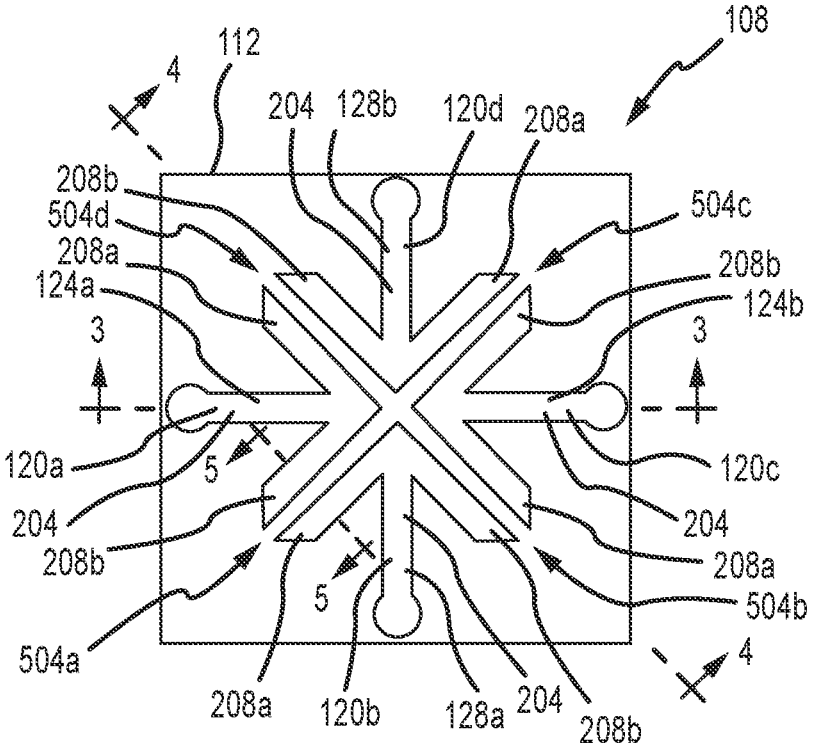
FIG. 2 depicts an antenna element in accordance with embodiments of the present disclosure in a plan view.

An example of an antenna element 108 in accordance with embodiments of the present disclosure is shown in a top plan view in FIG. 2. As shown, each antenna element 108 can include a number of dipole arms 120. For example, each antenna element 108 can include four dipole arms 120*a-d*. The four dipole arms 120 can divided into first 124 and second 128 pairs of dipole arms. In accordance with embodiments of the present disclosure, the first pair of dipole arms 124 can operate in connection with signals having a first polarization (e.g. a horizontal polarization), and the second pair of dipole arms 128 can operate in connection with signals having a second polarization (e.g. a vertical polarization) that is orthogonal to the first polarization. As shown, the dipole arms 120 can be interspersed, such that a first one 124*a* of the first pair 124 of dipole arms 120 occupies a first quadrant of the element 108, a first one 128*a* of the second pair 128 of dipole arms 120 occupies a second quadrant of the element 108, a second one 124*b* of the first pair 124 of dipole arms 120 occupies a third quadrant of the element 108, and a second one 128*b* of the second pair 128 of dipole arms 120 occupies a fourth quadrant of the element 108.

With continued reference to the top plan view of the antenna element shown in FIG. 2, each dipole arm 120 includes a trunk portion 204 and first 208*a* and second 208*b* branches that extend from one end of the trunk portion. In accordance with embodiments of the present disclosure, the first branch 208*a* can extend at an angle of 45° relative to a first side of the trunk portion 204, and the second branch 208*b* can extend at an angle of 45° relative to a second side of the trunk portion. Moreover, the first branch 208*a* of a dipole arm 120 can be disposed at an angle of 90° relative to the second branch 208*b* of that dipole arm 120. In addition, the first branch 208*a* of each dipole arm 120 within an antenna element 108 is adjacent to and faces the second branch 208*b* of another dipole arm 120 in that antenna element 108. For example, the first branch 208*a* within the first dipole arm 120*a* is adjacent and parallel to the second branch 208*b* of the fourth dipole arm 120*d*; the second branch 208*b* of the first dipole arm 120*a* is adjacent and parallel to the first branch 208*a* of the second dipole arm 120*b*; the second branch 208*b* of the second dipole arm 120*b* is adjacent and parallel to the first branch 208*a* of the third dipole arm 120*c*; and the second branch 208*b* of the third dipole arm 120*c* is adjacent and parallel to the first branch 208*a* of the fourth dipole arm 120*d*. In addition, in each dipole arm 120, an end of the trunk portion 204 opposite the end joined to the branch portions 208 can be connected to a feed line provided as part of or connected to a feed network included in or connected to the array antenna 104.

Figure 3:
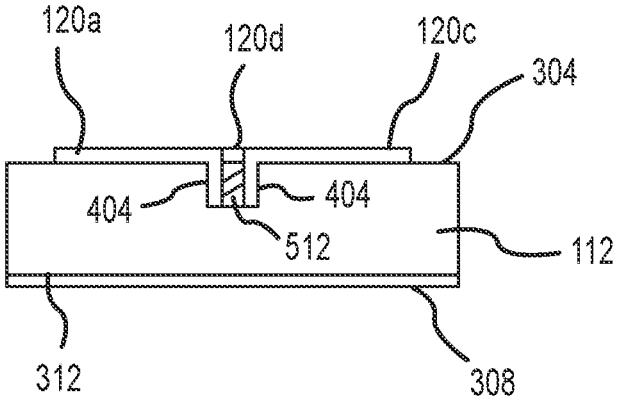
FIG. 3 depicts an antenna element in accordance with embodiments of the present disclosure in a cross-section view taken along section line 3-3 of FIG. 2.
Figure 4A:
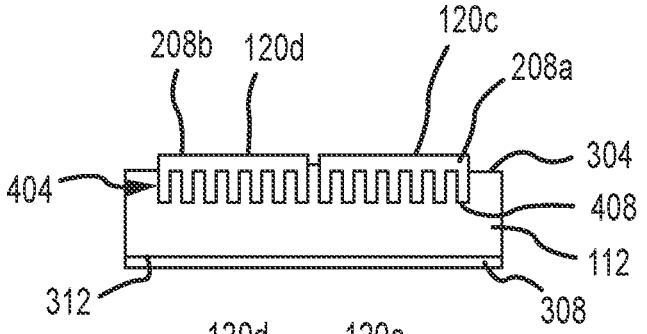
FIG. 4A depicts an antenna element in accordance with embodiments of the present disclosure in a cross-section view taken along section line 4-4 of FIG. 2.
Figure 4B:
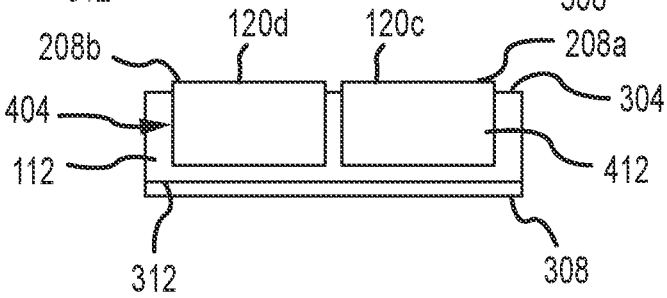
FIG. 4B depicts an antenna element in accordance with other embodiments of the present disclosure in a cross-section view taken along section line 4-4 of FIG. 2.
Figure 5:
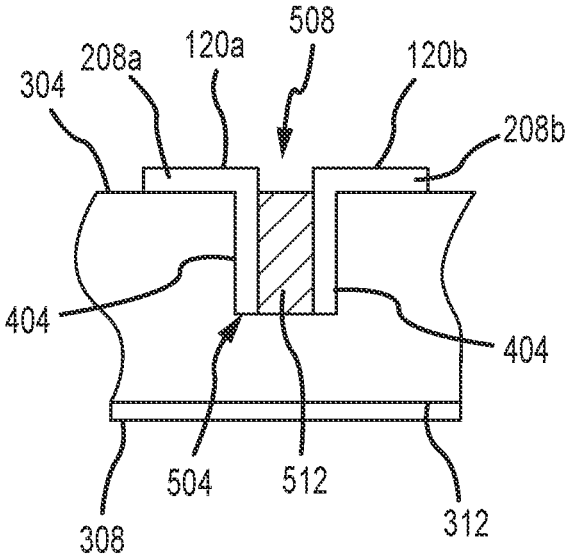
FIG. 5 depicts an antenna element in accordance with other embodiments of the present disclosure in a cross-section view taken along section line 5-5 of FIG. 2.

As shown in FIGS. 3-5, the trunk portion 204 and the branch portions 208 of each of the dipole arms 120 are disposed on or adjacent a first surface 304 of the antenna substrate 112. Moreover, the trunk portion 204 and the branch portions 208 of any one dipole arm 120 can be integrally formed from a sheet or layer of conductive material disposed on or adjacent the first surface 304 of the antenna substrate 112. A ground plane 308 is disposed on or adjacent a second surface 312 of the substrate 112, opposite the first surface 304. In accordance with embodiments of the present disclosure, the ground plane 308 is provided as a contiguous sheet or layer of conductive material that, when viewed along a line perpendicular to one of the surfaces 304 or 312, overlaps the area generally occupied by the dipole arms 120 of the antenna elements 108.

In accordance with embodiments of the present disclosure, the dipole arms 120 include capacitive elements 404 that are electrically connected to and extend from each of the branch portions 208 of those dipole arms 120, towards the ground plane 308. More particularly, the capacitive elements 404 extend at an angle to (e.g. in a direction perpendicular to) the top surface 304 of the antenna substrate 112. Moreover, the capacitive element 404 extending from any one branch portion 208 is adjacent and parallel to the capacitive element 404 extending from an adjacent branch portion 208, thereby forming a capacitive structure 504. As can be appreciated by one of skill in the art after consideration of the present disclosure, the capacitive elements 404 enable the capacitance between adjacent branch portions 208 of the elements 108 of the array antenna 104 to be increased as compared to a configuration in which conductive portions of the dipole arms 120 are confined to conductors that are on or adjacent the surface 304 of the substrate 112.

As shown in FIGS. 4A, and 4B, the capacitive elements 404 are directly connected to and extend from the branches 208 of the respective dipole arms 120, towards the ground plane 308. A spacing is maintained between edges of the capacitive elements 404 nearest the second side 312 of the substrate 112 and the ground plane 308. As shown in FIG. 4A, the capacitive elements 404 can be configured as a plurality of vertical elements 408. The vertical elements 408 within any one capacitive element 404 can be spaced apart from one another. Alternatively, some or all of the vertical elements 408 within any one capacitive element 404 can be in contact with one or more neighboring vertical elements 408. As can be appreciated by one of skill in the art after consideration of the present disclosure, the vertical elements 408 can be formed as a plurality of plated vias. As shown in FIG. 4B, the capacitive elements 404 can be configured as single contiguous conductive structure 412. In accordance with at least some embodiments of the present disclosure, a single contiguous structure 324 can be formed by edge plating. As a further example, a single contiguous structure 324 can be formed by filling a trench in the substrate 112 with a conductive material.

As depicted in FIG. 5, capacitive elements 404 extending from adjacent dipole arm 120 branch portions 208 are spaced apart from one another, thereby forming a capacitive structure 504. Accordingly, each pair of adjacent branch portions 208 within at least some of the antenna elements 108 of the array antenna 104 in accordance with embodiments of the present disclosure forms a capacitive structure 504. Thus, with reference again to FIG. 2, within an antenna element 108, a first capacitive structure 504*a* can be formed between the second branch 208*b* of the first dipole arm 120*a* and the first branch 208*a* of the second dipole arm 120*b*; a second capacitive structure 504*b* can be formed between the second branch 208*b* of the second dipole arm 120*b* and the first branch 208*a* of the third dipole arm 120*c*; a third capacitive structure 504*c* can be formed between the second branch 208*b* of the third dipole arm 120*c* and the first branch 208*a* of the fourth dipole arm 120*d*; and a fourth capacitive structure 504*d* can be formed between the second branch 208*b* of the fourth dipole arm 120*c* and the first branch 208*a* of the first dipole arm 120*a*. The volume 508 between adjacent capacitive elements 404 can be partially or entirely occupied by a dielectric or electrically insulating material 512. The inclusion of a dielectric material 512 can increase the capacitance of the capacitive structure 504, further reducing the low frequency cutoff of the antenna array 104. In accordance with further embodiments of the present disclosure, the volume 508 is partially or entirely occupied by air or some other gas. As can be appreciated by one of skill in the art after consideration of the present disclosure, the area of the capacitive elements 404, the dielectric characteristics of a material within the volume 508 between facing capacitive elements 404, and the distance between those facing capacitive elements 404, can be selected to obtain capacitive structures 504 having a desired amount of capacitance.

In accordance with at least some embodiments of the present disclosure, the shape and area of the capacitive element 404 connected to a branch 208 of a first dipole arm 120 mirrors the shape and area of the capacitive element 404 connected to an adjacent arm portion or branch 208 of a second dipole arm 120. For example, where capacitive elements 404 include a plurality of plated vias 408, the size and number of the plated vias 408 of facing capacitive elements 404 can be the same. Although particular examples of configurations of capacitive elements 404 included as part of capacitive structures 504 in accordance with embodiments of the present disclosure have been illustrated, other configurations are possible. For example, as an alternative to having a generally rectangular form, free edges of the capacitive elements 404 can be curved, can include a number of curved or angled segments, or can otherwise be configured in a desired shape. In addition, the facing capacitive elements 404 within a capacitive structure 504 are, in various embodiments of the present disclosure, parallel to one another. Alternatively, embodiments of the present disclosure can include capacitive structures 504 in which the capacitive elements are non-parallel to one another in one or more planes. In accordance with still further embodiments of the present disclosure, the capacitive elements 404 need not be perpendicular to the ground plane 308. Furthermore, an antenna array 104 in accordance with embodiments of the present disclosure can be disposed across more than one planar surface, and/or can be at least partially disposed across a curved surface. Where at least portions of the array antenna 104 are disposed across a first surface 304 of a substrate 112 that is itself curved, components of the antenna elements 108 can also be curved, to conform to the surface 304.

Figure 6A:
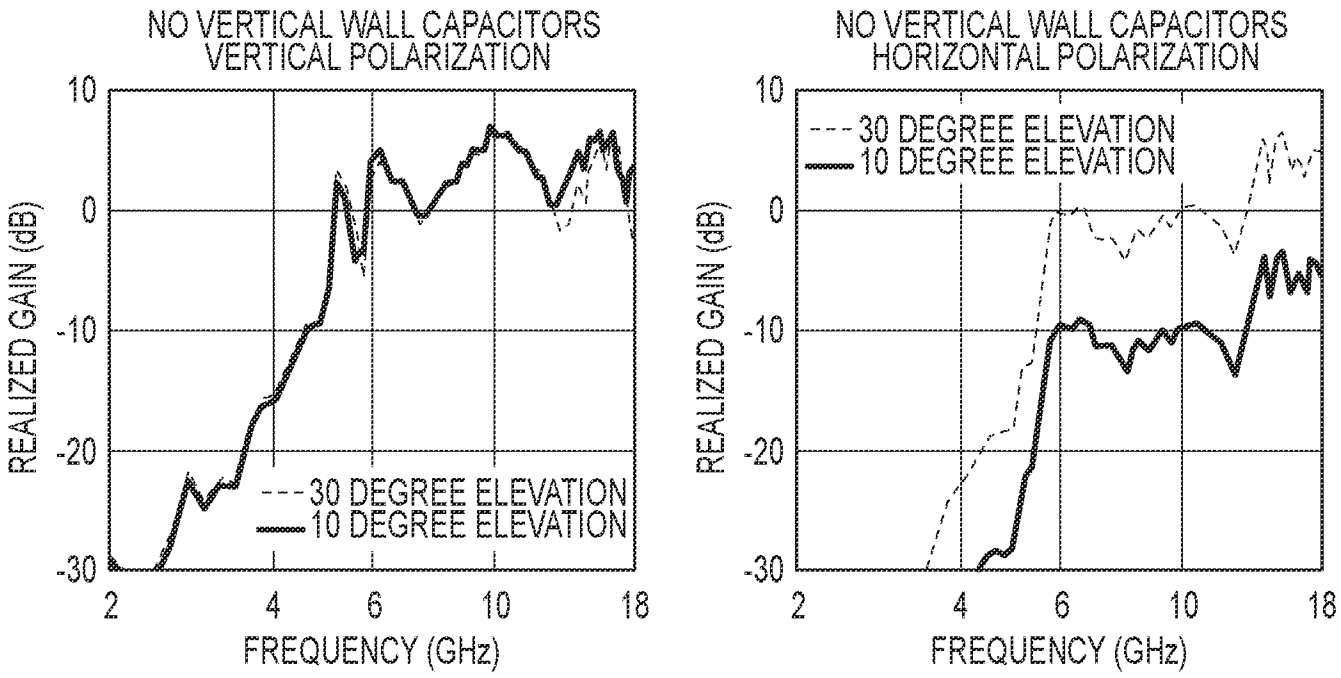
FIG. 6A illustrates the performance characteristics of an antenna with elements that do not include capacitive structures in accordance with embodiments of the present disclosure.
Figure 6B:
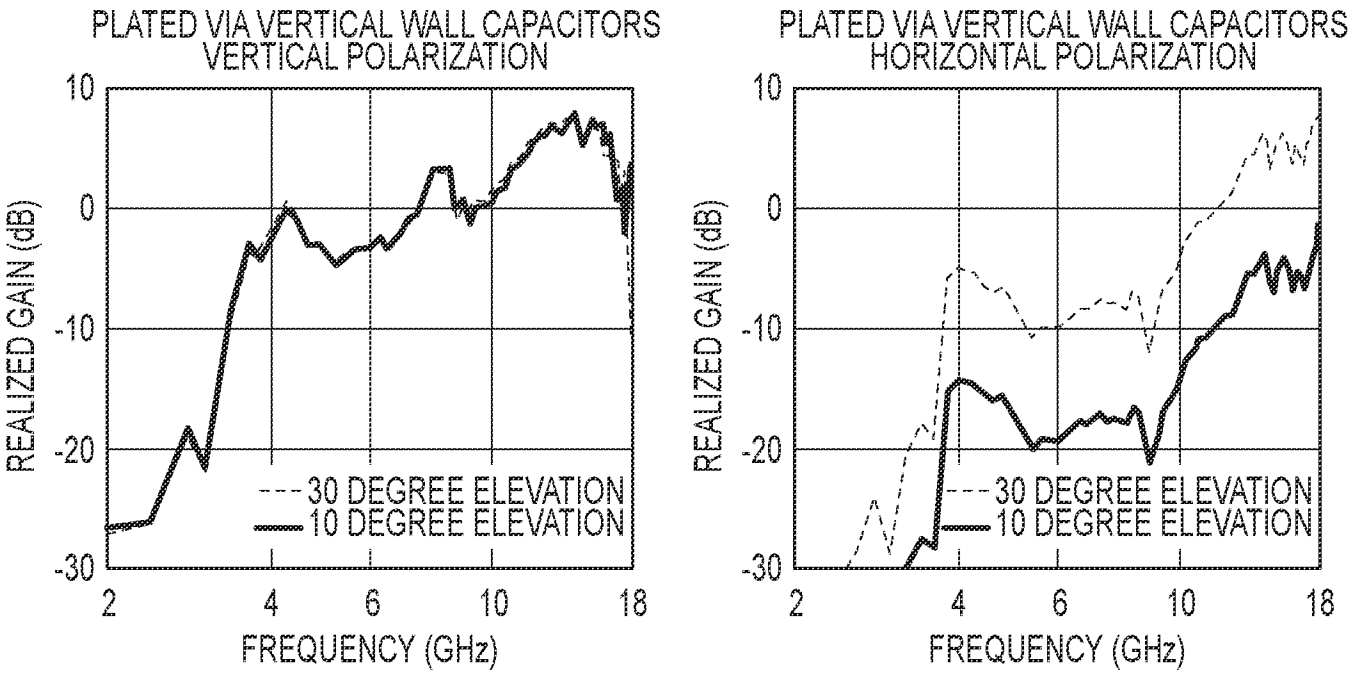
FIG. 6B illustrates the performance characteristics of an antenna with elements that include capacitive structures formed from plated vias in accordance with embodiments of the present disclosure.
Figure 6C:
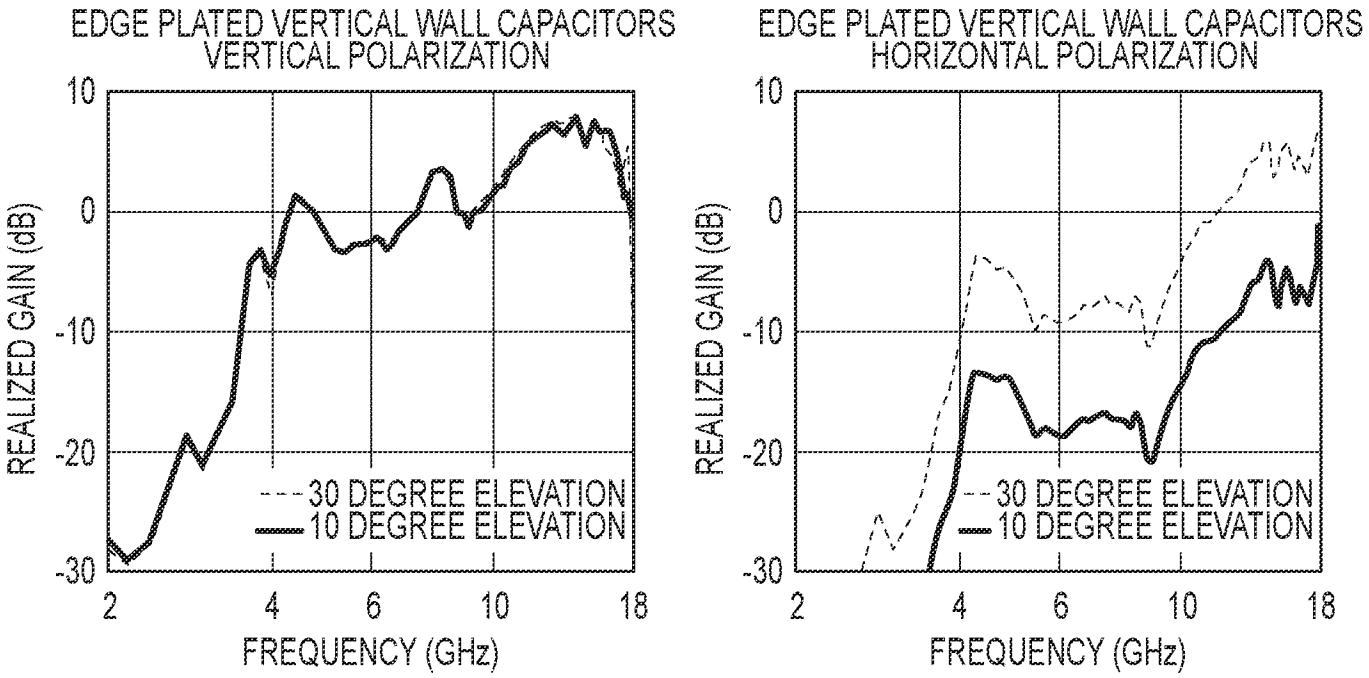
FIG. 6C illustrates the performance characteristics of an antenna with elements that include capacitive structures formed from edge plating in accordance with embodiments of the present disclosure.
Figure 6D:
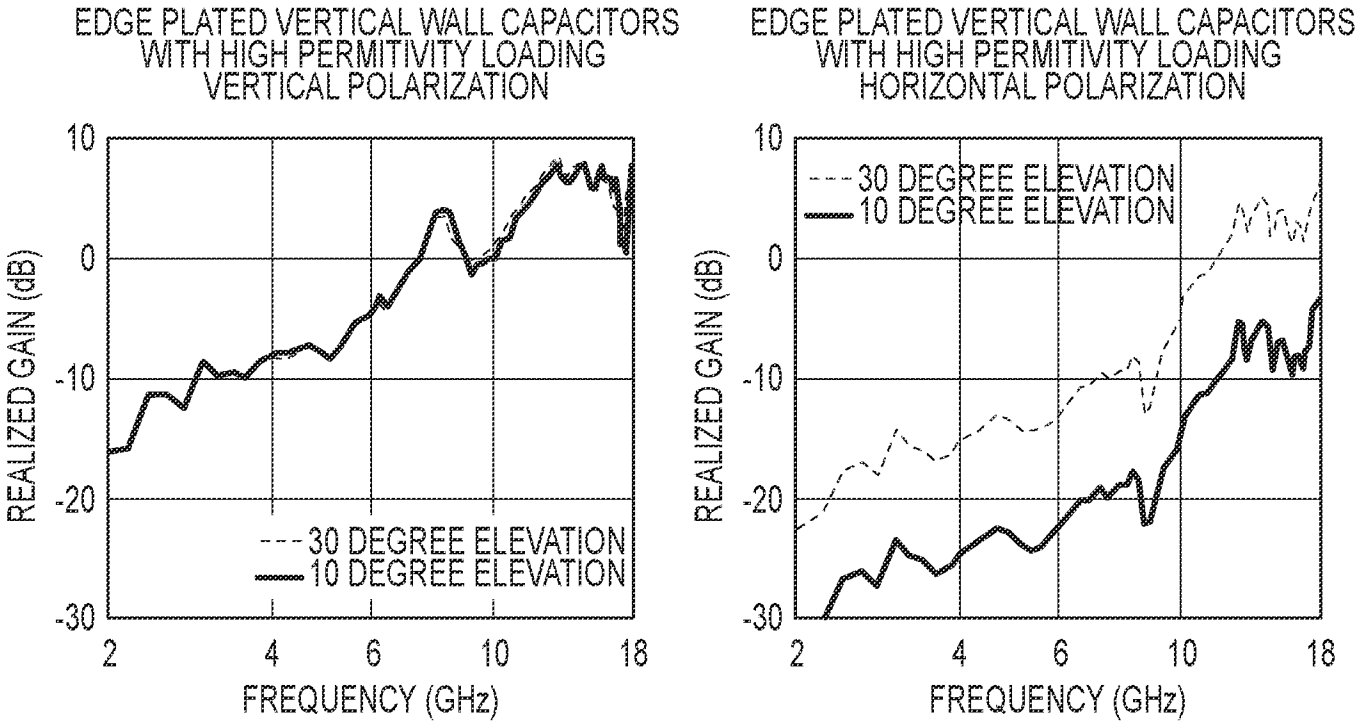
FIG. 6D illustrates the performance characteristics of an antenna with elements that include capacitive structures formed from edge plating and that include a dielectric material between adjacent capacitive elements in accordance with embodiments of the present disclosure.

FIGS. 6A-6D depict the swept gain performance of different example small finite arrays for both vertical and horizontal polarizations. In particular, FIG. 6A depicts the swept gain performance of an antenna array with elements that do not include capacitive structures as disclosed herein. FIG. 6B depicts the swept gain performance of an array antenna 104 with capacitive elements 404 in the form of plated vias 408 in accordance with embodiments of the present disclosure. Comparing FIGS. 6A and 6B it can be seen that the cut off frequency at the low end of the antenna bandwidth is decreased if the array antenna 104 includes antenna elements 108 having capacitive elements 404 as disclosed herein. Similarly, as shown in FIG. 6C, the inclusion of capacitive elements 404 in the form of contiguous conductive structures 412 extends the bandwidth of the array antenna 104. FIG. 6D illustrates that even greater low end performance can be achieved by establishing a high permittivity loading through the inclusion of a high dielectric material 512 between facing capacitive elements 404 within the capacitive structures 504 of embodiments of the present disclosure.

Accordingly, the elements 108 of the array antenna 104 in accordance with embodiments of the present disclosure may be formed using orthogonal-coupled dipole elements 120, for example dipole arms or dipoles. Moreover, horizontal polarized and vertical polarized resonant loops may be formed by balancing the capacitance between elements with the inductance of the loops.

Figure 7:
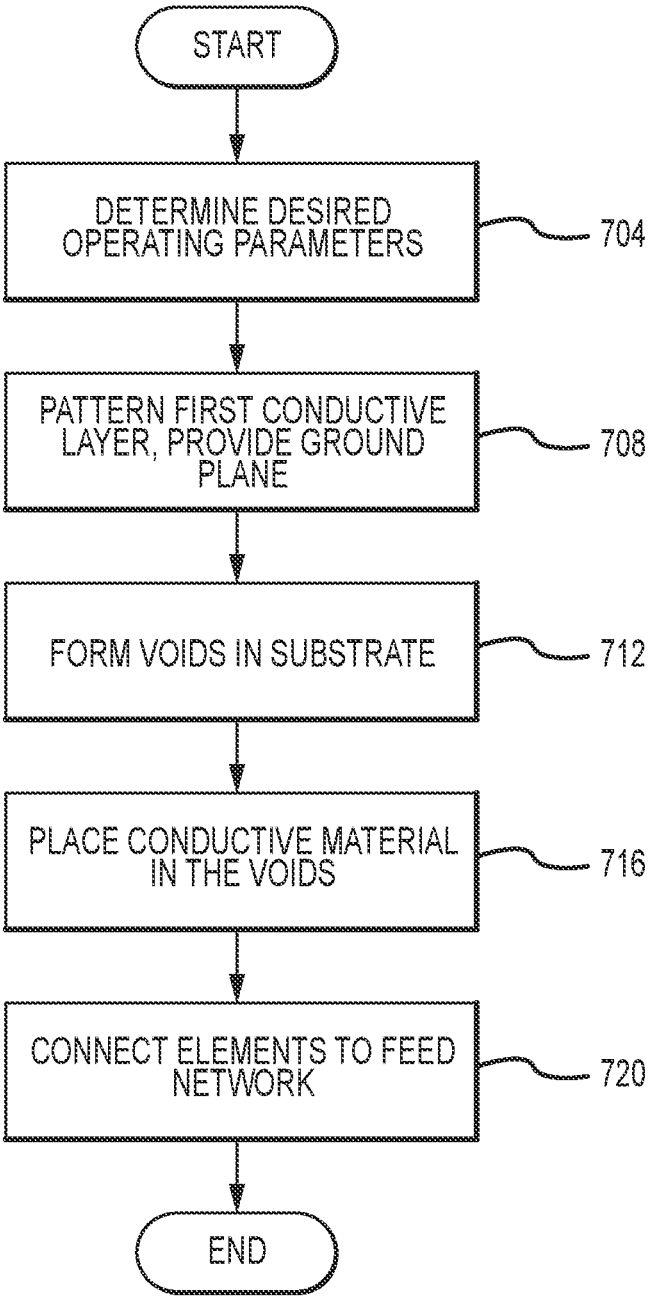
FIG. 7 depicts aspects of a method for providing an array antenna in accordance with embodiments of the present disclosure.

Aspects of a method for providing an array antenna 104 in accordance with embodiments of the present disclosure are depicted in FIG. 7. In particular, the method enables the provision of an array antenna 104 with an extended usable bandwidth as compared to various prior art techniques. Initially, at step 704, the desired frequencies, steering capabilities, and/or other operational parameters of the antenna system are determined. As can be appreciated by one of skill in the art after consideration of the present disclosure, such parameters at least partially determine the number of elements 108 within the array, and the configuration of each of the individual elements 108. Moreover, where an extended operating bandwidth is desired, embodiments of the present disclosure enable the capacitance between dipole arms 120 within an antenna element 108 to be increased by a selected amount by providing capacitive structures 504 between adjacent dipole arm branches 208 that can have a selected spacing and area.

At step 708, a first conductive layer can be patterned to provide at least the planar portions of the antenna elements 108 on a first surface 304 side of a dielectric, which dielectric corresponds to the antenna substrate 112. Patterning the first conductive layer can include an additive process, where a conductive material, such as aluminum or some other metal, is printed, deposited, or otherwise applied to the first surface 304 of the substrate 112. Alternatively or in addition, pattering the first conductive layer can include a subtractive process in which conductive material is removed from a conductive layer applied across all or portions of the first surface 304 of the substrate 112, to obtain the desired patterns of at least the trunk 204 and branch 208 portions of the dipole arms 120 included in each of the elements 108. As can be appreciated by one of skill in the art after consideration of the present disclosure, a ground plane 308 in the form of a conductive sheet can be formed or placed on a second side 312 of the substrate 112, opposite the first side 304 of that substrate. As can further be appreciated by one of skill in the art, the process of patterning a first conductive layer and of providing a ground plane can include utilizing conventional printed circuit board (PCB) materials and processes.

At step 712, voids that extend from the first surface 304 side of the substrate 112 and towards the second side of the substrate, are formed between adjacent dipole element branches 208. For example, a trench can be formed adjacent an edge of each branch 208 that faces another branch within each element 108. Accordingly, a pair of trenches can be formed. Alternatively, a single trench that in a width direction extends between the facing edges of adjacent branches 208 within an element 108 can be formed. The trench can be formed by various methods, such as chemical etching or mechanical removal. As still another example, a series of holes or vias can be etched or drilled adjacent an edge of each branch 208 that faces another branch 208 within each element 108. Where a series of holes that are spaced apart from one another are formed, a fence like capacitive element 404 will be formed. Alternatively, a series of holes can be formed such that neighboring holes overlap one another, enabling a contiguous capacitive element 404 to be formed.

A conductive material is then placed in the voids to form capacitive elements 404 that are electrically joined to a corresponding branch 208 (step 716). For example, where trenches or a series of vias are formed adjacent an edge of each branch 208, the resulting voids can be filled with a conductive material, for example as a liquid or a paste that later hardens. As another example, such as where a single trench is formed between adjacent branches, conductive material can be plated on the facing sidewalls of the trench. Regardless of how the conductive material is disposed within the trenches or vias, it is placed in direct, electrical contact with the respective branches 208, thus forming the capacitive elements 404 of the array antenna 104.

The elements 108 can then be connected to a feed network, and in turn to transmit and/or receive electronics, forming an operational array antenna 104 (step 720). The array antenna 104 can then be associated with a platform and deployed.

Although various steps of a method have been presented in a particular sequence, it should be appreciated that the steps discussed herein can be rearranged. For example, voids for receiving conductive material to form capacitive elements 404 can be formed prior to or during the patterning of the first conductive layer. Moreover, other or additional processes can be used to form an array antenna 104 as described herein.

The foregoing discussion of the disclosed systems and methods has been presented for purposes of illustration and description. Further, the description is not intended to limit the disclosed systems and methods to the forms disclosed herein. Consequently, variations and modifications commensurate with the above teachings, within the skill or knowledge of the relevant art, are within the scope of the present disclosure. The embodiments described herein are further intended to explain the best mode presently known of practicing the disclosed systems and methods, and to enable others skilled in the art to utilize the disclosed systems and methods in such or in other embodiments and with various modifications required by the particular application or use. It is intended that the appended claims be construed to include alternative embodiments to the extent permitted by the prior art.

What is claimed is:

1. An antenna element, comprising:
a substrate;
a first dipole arm disposed on a first surface of the substrate;
a second dipole arm disposed on the first surface of the substrate;
a first capacitive structure, wherein the first capacitive structure includes:
a first capacitive element that extends from a branch portion of the first dipole arm towards a second surface of the substrate; and
a second capacitive element that extends from a branch portion of the second dipole arm towards the second surface of the substrate,
wherein the branch portion of the first dipole arm from which the first capacitive element extends is adjacent the branch portion of the second dipole arm from which the second capacitive element extends, and
wherein the first surface of the substrate is opposite the second surface of the substrate.

2. The antenna element of claim 1, wherein the capacitive elements are parallel to one another.

3. The antenna element of claim 1, wherein the capacitive elements are perpendicular to the first surface of the substrate.

4. The antenna element of claim 1, wherein the capacitive elements include a plurality of plated vias.

5. The antenna element of claim 1, wherein the capacitive elements include contiguous conductive walls.

6. The antenna element of claim 1, wherein the first and second surfaces of the substrate are parallel to one another.

7. The antenna element of claim 1, further comprising:
a ground plane, wherein the ground plane is disposed on the second surface of the substrate.

8. The antenna element of claim 1, further comprising:
a dielectric material in a volume between the first and second capacitive elements.

9. The antenna element of claim 1, further comprising:
a gas in a volume between the first and second capacitive elements.

10. The antenna element of claim 1, further comprising:
a third dipole arm;
a fourth dipole arm;
a second capacitive structure;
a third capacitive structure; and
a fourth capacitive structure.

11. The antenna element of claim 10,
wherein the first capacitive element of the first capacitive structure extends from a second branch portion of the first dipole arm,
wherein the second capacitive element of the first capacitive structure extends from a first branch portion of the second dipole arm,
wherein the second capacitive structure includes:
a first capacitive element that extends from a second branch portion of the second dipole arm towards the second surface of the substrate; and
a second capacitive element that extends from a first branch portion of the third dipole arm,
wherein the third capacitive structure includes:
a first capacitive element that extends from a second branch portion of the third dipole arm towards the second surface of the substrate; and
a second capacitive element that extends from a first branch portion of the fourth dipole arm, and
wherein the fourth capacitive structure includes:
a first capacitive element that extends from a second branch portion of the fourth dipole arm towards the second surface of the substrate; and
a second capacitive element that extends from a first branch portion of the first dipole arm.

12. The antenna element of claim 11, wherein viewed along a line perpendicular to the first surface of the substrate:
the capacitive elements of the first and third capacitive structures are parallel to a first line,
the capacitive elements of the second and fourth capacitive structures are parallel to a second line, and
the first line is perpendicular to the second line.

13. The antenna element of claim 12, wherein each of the dipole arms includes a trunk portion, and wherein the branch portions of each of the dipole arms intersect one another at one end of the trunk portion.

14. An array antenna, comprising:
a substrate, wherein the substrate includes a first side and a second side opposite the first side;
a plurality of antenna elements, wherein each of the antenna elements includes:
first, second, third, and fourth dipole arms disposed on the first side of the substrate, wherein each of the dipole arms includes first and second branch portions; and
a plurality of capacitive elements, wherein at least one of the capacitive elements extends from each branch portion of each of the dipole arms in a direction towards the second side of the substrate.

15. The array antenna of claim 14, further comprising:
a ground plane disposed on the second side of the substrate, wherein the capacitive elements are spaced apart from the ground plane.

16. The array antenna of claim 15, wherein each branch portion in any one of the antenna elements is adjacent another branch portion in the same antenna element.

17. The array antenna of claim 16, further comprising:
a plurality of trunk portions, wherein each dipole arm includes one trunk portion that is electrically connected to the branch portions of the respective dipole arm.

18. The array antenna of claim 17, further comprising:
a feed network, wherein the trunk portion of each dipole arm connects the respective dipole arm to the feed network.

19. The array antenna of claim 14, wherein the plurality of antenna elements are disposed in a planar array.

20. A method of forming an antenna element, comprising:
patterning a conductive layer on a first side of a substrate, wherein a plurality of dipole arms are formed;
providing a ground plane on a second side of the substrate;
forming voids that extend from the first side of the substrate and towards the second side of the substrate, wherein each void is adjacent a portion of a dipole arm included in the plurality of dipole arms; and placing a conductive material in the voids, wherein the conductive material in each of the voids is in electrical contact with a corresponding portion of the dipole arms, and wherein the conductive material in each of the voids is not in electrical contact with the ground plane.

* * * * *